US007107668B2

(12) United States Patent
Nishi

(10) Patent No.: US 7,107,668 B2
(45) Date of Patent: Sep. 19, 2006

(54) METHOD OF MANUFACTURING A LONGITUDINAL MICROSOLENOID

(76) Inventor: Takashi Nishi, 8-14 Takezono 1-chome, Room 213, Bldg. 906, Tsukuba-shi, Ibaraki (JP) 305-0032

( * ) Notice: Subject to any disclaimer, the term of this patent is extended or adjusted under 35 U.S.C. 154(b) by 220 days.

(21) Appl. No.: 10/817,273

(22) Filed: Apr. 2, 2004

(65) Prior Publication Data

US 2004/0187295 A1 Sep. 30, 2004

Related U.S. Application Data

(62) Division of application No. 09/914,542, filed as application No. PCT/JP00/02407 on Apr. 13, 2000, now Pat. No. 6,725,528.

(30) Foreign Application Priority Data

Apr. 14, 1999 (JP) ..... 11-155546
Apr. 27, 1999 (JP) ..... 11-170062

(51) Int. Cl.
*H01F 7/06* (2006.01)

(52) U.S. Cl. ..... 29/606; 29/602.1; 29/846; 29/847; 216/2; 216/39; 216/49; 216/58; 216/67; 427/96; 427/97; 427/116; 427/123; 427/124; 428/3; 428/42; 428/57; 428/98; 430/313; 430/316; 430/317

(58) Field of Classification Search ..... 29/606, 29/602.1, 846, 847; 427/96, 97, 116, 123, 427/124; 428/3, 42, 57, 98; 216/2, 39, 49, 216/58, 67; 430/313, 316, 317
See application file for complete search history.

(56) References Cited

U.S. PATENT DOCUMENTS 3,290,758 A * 12/1966 Moyer ..... 438/3
5,514,832 A * 5/1996 Dusablon et al. ..... 174/15.1
6,303,971 B1 * 10/2001 Rhee ..... 257/531

FOREIGN PATENT DOCUMENTS

JP 52046787 A * 4/1977
JP 60173737 A * 9/1985
SU 1028813 A * 7/1983

OTHER PUBLICATIONS

"Helical microstructures grown by laser assisted chemical vapor deposition"; Boman, M.; Westberg, H.; Johansson, S.; Schweitz, J.-A.; 1992, MEMS '92, Proceedings; Feb. 4-7, 1992; pp. 162-167.*

* cited by examiner

*Primary Examiner*—Paul D. Kim
(74) *Attorney, Agent, or Firm*—Jordan and Hamburg LLP

(57) ABSTRACT

A photosensitive material is coated on an insulating material (13) stacked on a substrate (1) (FIG. 16A), and exposed and developed using a mask having a light-shielding film capable of controlling a light transmittance from 100% to 0% annularly and continuously to form a spiral photosensitive material (FIG. 16B). After conducting treatment at a high temperature, the insulating material under the photosensitive material is spirally formed by etching (FIG. 16C). A metal (12) is stacked on the substrate (FIG. 16D), and a photosensitive material is coated (FIG. 16E). The photosensitive material is exposed and developed using a mask having an annular light-shielding film with a light transmittance of 0% to leave the photosensitive material covering only the metal on the base of the spiral structure (FIG. 16F). After treatment at a high temperature is conducted and the metal exposed is etched (FIG. 16G), the photosensitive material is removed (FIG. 16H).

1 Claim, 17 Drawing Sheets

PRIOR ART

METHOD OF MANUFACTURING A LONGITUDINAL MICROSOLENOID

This is a division of application Ser. No. 09/914,542 filed Aug. 29, 2001, now U.S. Pat. No. 6,725,528.

TECHNICAL FIELD

The present invention relates to a microsolenoid coil which can be formed into a lateral or longitudinal spiral coil having a section of a circle that is nearly a complete circle by controlling exposure drawing on a photosensitive material, and a method of manufacturing the same.

BACKGROUND OF THE INVENTION

An inductance such as a solenoid coil or the like has often been used thus far in electric circuits other than microcircuits, such as in a semiconductor integrated circuit and the like. In microcircuits such as a semiconductor integrated circuit and the like, a transistor, a resistor, a condenser and the like are used. However, an inductance such as a solenoid coil involves many technical problems in that it is, in comparison with other elements, complex and difficult to manufacture.

A schematic view of a projection exposure device used in a lithographic step of baking a pattern which is one step of manufacturing a semiconductor is shown in FIG. 26. The view shown therein indicates that a photosensitive material 10 is of a positive type, and after development the photosensitive material 10 to which a light is not applied remains, and the photosensitive material 10 to which a light is applied is removed. A light 4 emitted from a light source transfers a pattern onto a mask M onto the photosensitive material 10 on a substrate 1 in a lightness and darkness form. For example, when a pattern made of an annular light-shielding film 8 is exposed through projection and developed on the substrate 1, the photosensitive material 10 is doughnut-shaped, and never spiral. The mask M used conventionally is made only of a glass 7, and transmits a light by approximately 100% in a region free of the light-shielding film 8, while it has a light transmittance of 0 and does not transmit a light in a region having the light-shielding film 8.

In order to solve the problems of this kind of the inductor element, a manufacturing technique is proposed in, for example, Japanese Patent Laid-Open NOS. 189,339/1998 and 313,093/1998. With respect to a method of forming a lateral coil, Japanese Patent Laid-Open No. 189,339/1998 discloses a technique in which an isotropic etching method or a method of a combination of anisotropic etching and isotropic etching is used as a method of forming a semicircular groove, and whereby polysilicon or amorphous silicon previously embedded in a groove portion is then stacked and expanded by oxidation for forming a cylindrical shape of a coil section. Further, Japanese Patent Laid-Open No. 313,093/1998 discloses a technique in which flat spiral inductors are vertically stacked via an insulation layer, and whereby, at this time, the upper and lower inductors are selectively connected spirally via through-holes formed in the insulation layer to form a two-layer spiral coil.

Incidentally, a filter circuit is inherently formed by a combination of a resistor, a condenser and a coil. A filter circuit formed on an existing semiconductor integrated circuit is however constructed by using a resistor, a condenser and a transistor. Since a coil is not used, a large number of parts, resistors, condensers and transistors are required to realize a filter circuit having desired characteristics, and chip size is thereby increased. In addition, transistors tend to be influenced by the temperature of the usage environment. Thus, the larger the number of transistors used, the more unstable the characteristics of the overall circuit tend to be.

Moreover, as the scale of the integrated circuit becomes larger, a wiring width of an electric wiring in the integrated circuit is more decreased, and the wiring route becomes longer, with the result that wiring resistance and the capacitance of wirings are increased. Consequently, there arise problems such that the speed of charge passing through wiring is controlled, and the rate of delay of a current is increased.

Meanwhile, in a technique disclosed in Japanese Patent Laid-Open No. 189,339/1998, as a method of forming an inductor element on a substrate, a method of forming a cylindrical portion of a lateral coil includes an isotropic etching method, or a method of a combination of anisotropic etching and isotropic etching and a method in which polysilicon or amorphous silicon is stacked and expanded by oxidation. Therefore, with this method, it is difficult to form a cylindrical section in the shape of a complete circle with high precision. For this reason, a change in the magnetic field cannot be uniformly maintained.

Further, the technique disclosed in Japanese Patent Laid-Open No. 313,093/1998 is problematic, in that the spiral coil in which the upper and lower coils are spirally stacked via the through holes leaks a magnetic flux outside the coil in comparison with a solenoid coil, and a change in the magnetic field thus cannot be rendered uniform.

The invention aims to provide a microsolenoid coil in which an inductance value can easily be increased by controlling an occupied area of a coil in a substrate, and whereby a change in the magnetic field can uniformly be maintained by retaining the magnetic flux within the coil.

DISCLOSURE OF THE INVENTION

The invention completes a lateral spiral coil by connecting a metal wiring of a lower half formed first with a metal wiring of an upper half formed finally.

Further, the invention completes a coil of a longitudinal spiral structure with multiple winding by stacking spiral metal windings thus formed.

According to the invention, an inductance value can easily be increased by controlling an occupied area of a coil in a substrate, and a change in a magnetic field can uniformly be maintained by retaining the magnetic flux within the coil.

Further, a solenoid coil can be formed on a microcircuit such as an integrated circuit or the like. And an integrated circuit having a small number of parts and having the stable characteristics of a circuit can be realized by connecting a single solenoid coil or plural coils having a required inductance performance. A high reliability with a small size can be expected from electronic appliances constructed of such an integrated circuit. And, the problem of delay that is expected from a larger-scale integrated circuit can be diminished by mounting solenoid coils in required positions.

BEST MODE FOR CARRYING OUT THE INVENTION

Figure 1:
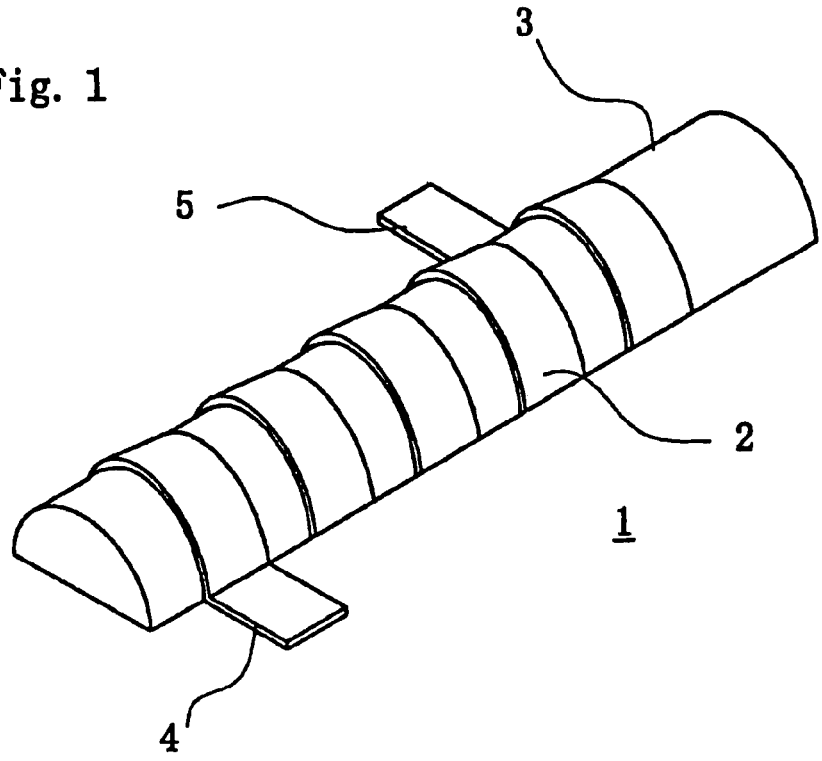
FIG. 1 is a perspective view of a lateral spiral coil manufactured by the method of the invention.
Figure 2:
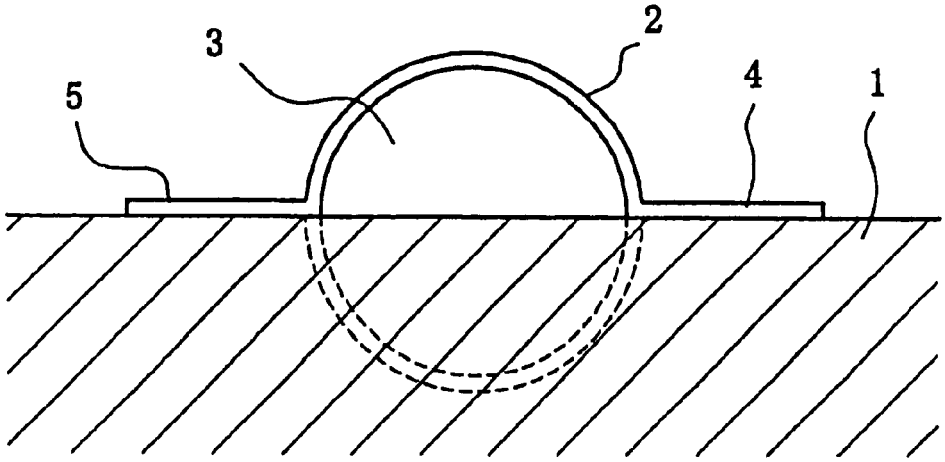
FIG. 2 is a side view of a lateral spiral coil manufactured by the method of the invention.

The invention is described more detail by referring to the drawings attached. Examples of the invention are explained by referring to the drawings. A method of manufacturing a microsolenoid coil using an ordinary semiconductor fine processing technique is explained by referring to the drawings. The microsolenoid coil of this Example is a lateral spiral coil (hereinafter simply referred to as a "spiral coil") having a section of a complete circle. FIG. 1 is a perspective view of a lateral spiral coil manufactured by the method of the invention, and FIG. 2 is a side view of a lateral spiral coil manufactured by the method of the invention.

The lateral spiral coil has a structure such that a lower half coil portion 2 is formed on a groove bottom provided on a substrate 1 and has a section of a half of a complete circle, and such that an upper half coil portion 2 is formed on an outer peripheral surface of a cylindrical portion 3 protruded from the substrate 1, and such that leader lines 4, 5 are drawn from the coil portion 2.

(1) Step A for Forming a Portion Which Becomes a Lower Half of a Spiral Coil

Figure 8:
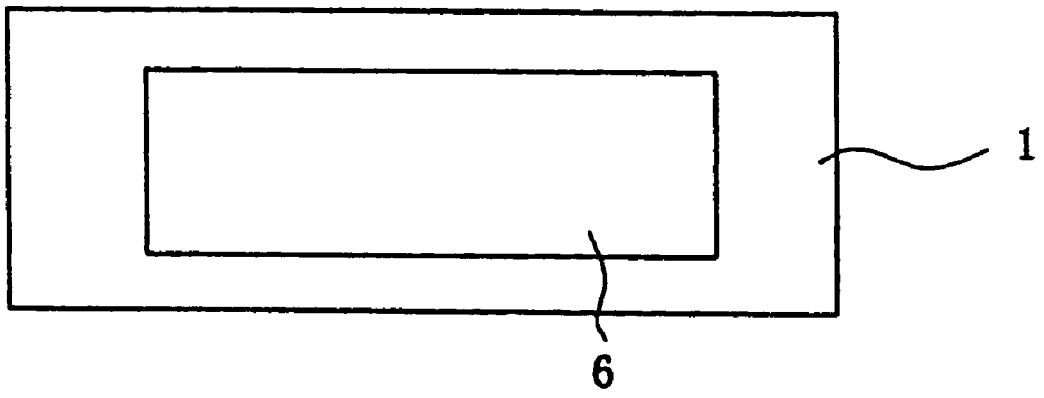
FIG. 8 is a plan view of a substrate in a step (A) of forming a lateral spiral coil by the method of the invention.

In step A is formed a groove portion 6 which becomes a lower half external portion of a spiral coil, and which has a section of a half of a complete circle on the substrate 1, as shown in FIG. 8.

Figure 3A:
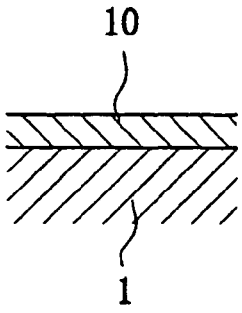
FIGS. 3A–3N constitute a flow chart of a method of manufacturing a lateral spiral coil as shown by sectional views.
Figure 3B:
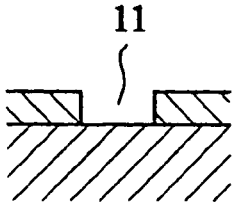
Figure 3C:
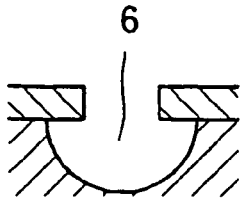
Figure 3D:
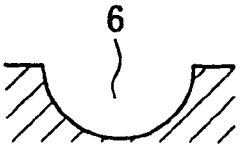

A photosensitive material 10 is coated onto the substrate 1 (FIG. 3A). Exposure drawing is applied to the photosensitive material 10 using a mask having a rectangular pattern on whose outside a light-shielding film is present, and on whose inside a light-shielding film is absent (FIG. 3B). The exposed photosensitive material 10 is developed and treated at a high temperature, and the remaining photosensitive material is solidified. A portion at which the substrate surface is exposed is subjected to isotropic etching by a wet etching method using the photosensitive material solidified as a protecting film to form the groove portion 6 (FIG. 3C) which is a half of a circle. Then, the photosensitive material 10 is removed (FIG. 3D).

(2) Step B for Forming a Metal Wiring of a Lower Half of a Spiral Coil

Figure 9:
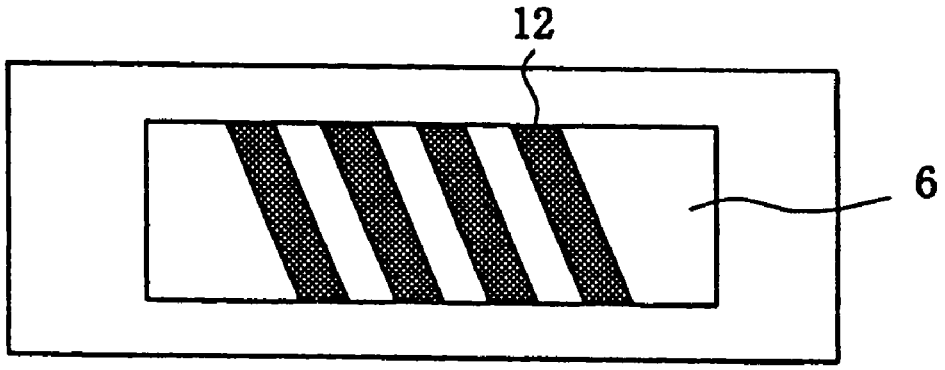
FIG. 9 is a plan view of a substrate in a step (B) of forming a lateral spiral coil by the method of the invention.

In step B is formed a metal wiring 12 of a lower half of a spiral coil on the groove portion 6 of the substrate 1, as shown in FIG. 9.

Figure 3E:
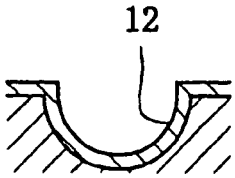
Figure 3F:
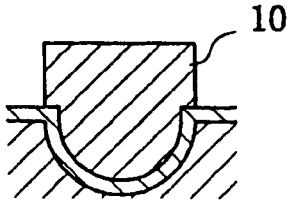
Figure 3G:
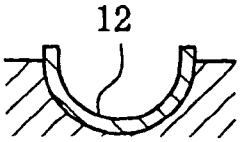

A metal 12 such as aluminum or the like is uniformly stacked, by sputtering, upon the whole surface of the substrate 1 from which the photosensitive material 10 has been removed in step A (FIG. 3E). A photosensitive material 10 is coated thereon, and an inclined ladder pattern of the lower half of the spiral coil is drawn by exposure, then developed, and treated at a high temperature (FIG. 3F). The exposed metal 12 is removed by etching, and the photosensitive material 10 is then removed (FIG. 3G).

Figure 10:
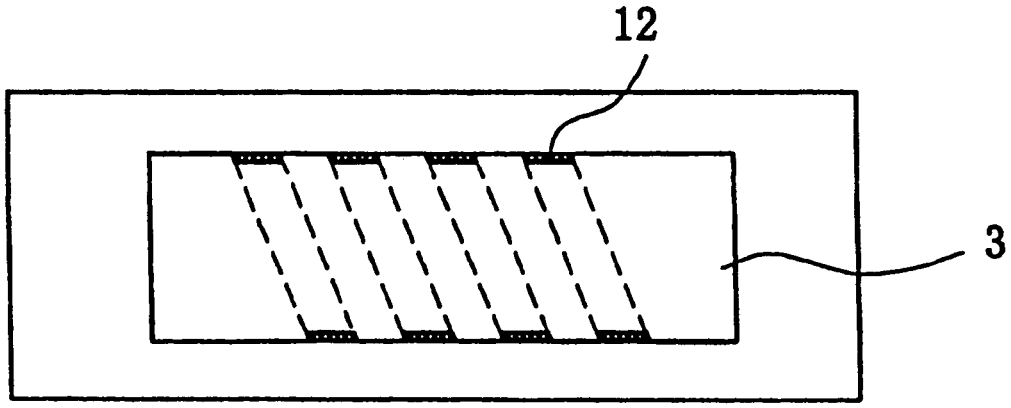
FIG. 10 is a plan view of a substrate in a step (C) of forming a lateral spiral coil by the method of the invention.

(3) Step C for Forming a Cylinder of a Hollow Portion of a Spiral Coil with an Insulating Material In step C is formed a cylindrical portion 3, made of an insulating material 13, inside the spiral coil in which the lower half is formed, as shown in FIG. 10.

Figure 3H:
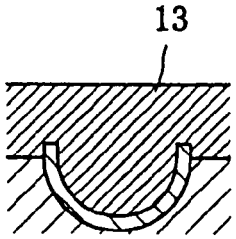
Figure 3I:
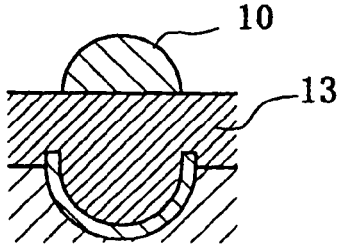
Figure 3J:
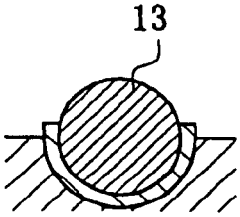

In order to form a site which becomes an inside portion of the spiral coil, an insulating material 13 such as a silicon oxide film is stacked on the surface of the substrate which includes the spiral coil of the lower half as formed in step B (FIG. 3H). The insulating material 13 is stacked such that the thickness of the insulating material 13 is equal to the diameter of the circle constituting the inside portion of the spiral coil. The photosensitive material 10 is coated on the substrate 1 by adjusting the number of rotations such that the film thickness of the photosensitive material 10 is equal to the radius of the circle. In order to form the inside portion, the exposure and the development are conducted using a mask having a rectangular pattern on whose inside a light-shielding film is present and on whose outside a light-shielding film is absent, and of which the short-side width is equal to the diameter of the circle of the section constituting the inside portion of the spiral coil. Subsequently, the substrate is maintained for a fixed period of time at a temperature adjusted such that the sectional shape of the photosensitive material is similar to the semicircular shape of the spiral coil (FIG. 3I). As soon as the etching speeds of the photosensitive material 10 and the insulating material 13 become equal, the etching is conducted to directly transfer the shape of the photosensitive material 10 having the semicircular section onto the insulating material 13 as an undercoat, using such anisotropic dry etching conditions that the etching proceeds only vertically (FIG. 3J).

In this Example, the photosensitive material 10 is made to have the circular section in the step of FIG. 3I. However, in the invention, the sectional shape of the photosensitive material 10 is not necessarily semicircular, nor are the film thicknesses and the etching speeds of the photosensitive material 10 and the insulating material 13 necessarily equal. In this step, the conditions can be those under which the sectional shape of the insulating material 13 in the inside portion becomes finally circular.

(4) Step D for Forming a Metal Wiring of an Upper Half of a Spiral Coil

Figure 11:
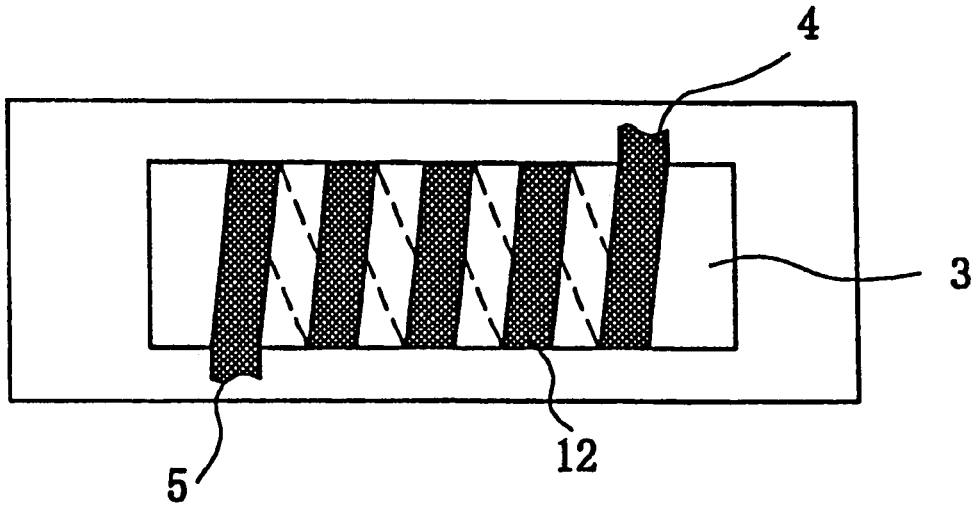
FIG. 11 is a plan view of a substrate in a step (D) of forming a lateral spiral coil by the method of the invention.

In step D is formed a metal wiring 12 of an upper half (coil portion 2 and leader lines 4, 5) according to the lower half of the spiral coil as formed by the steps A to C, as shown in FIG. 11.

Figure 3K:
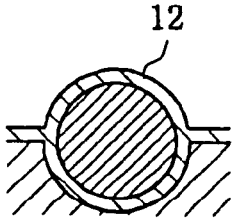
Figure 3L:
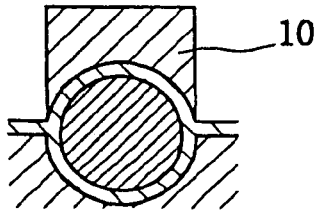
Figure 3M:
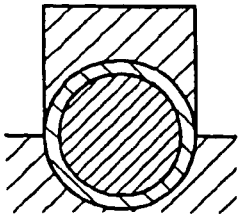
Figure 3N:
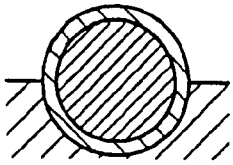

A metal 12 is uniformly stacked on the substrate including the lower half of the spiral coil formed in step C (FIG. 3K). The photosensitive material 10 is coated, and a ladder pattern of an upper half of the spiral coil is drawn by exposure, developed, and treated at a high temperature (FIG. 3L). As the ladder pattern at this time, a ladder pattern inclined in the opposite direction to that of the inclined ladder pattern drawn in FIG. 3F is used. The metal 4 covered with the photosensitive material 10 (coil portion 2 and leader lines 4, 5) is left, the other exposed metal is removed by etching (FIG. 3M), after which the photosensitive material 10 is then removed (FIG. 3N).

According to this Example, since the leader lines 4, 5 are drawn from both ends of the spiral coil, connection can be made with another circuit of a resistor, a condenser, a transistor or the like formed on the same substrate.

Figure 4:
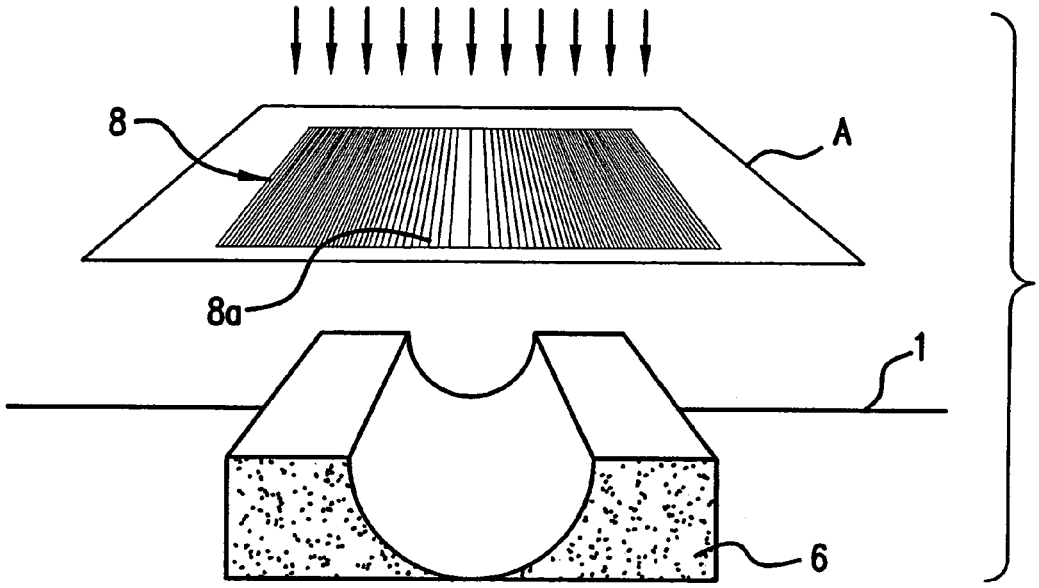
FIG. 4 is a simplified perspective view of exposure drawing using a mask A when forming a lateral spiral coil by the method of the invention.
Figure 5:
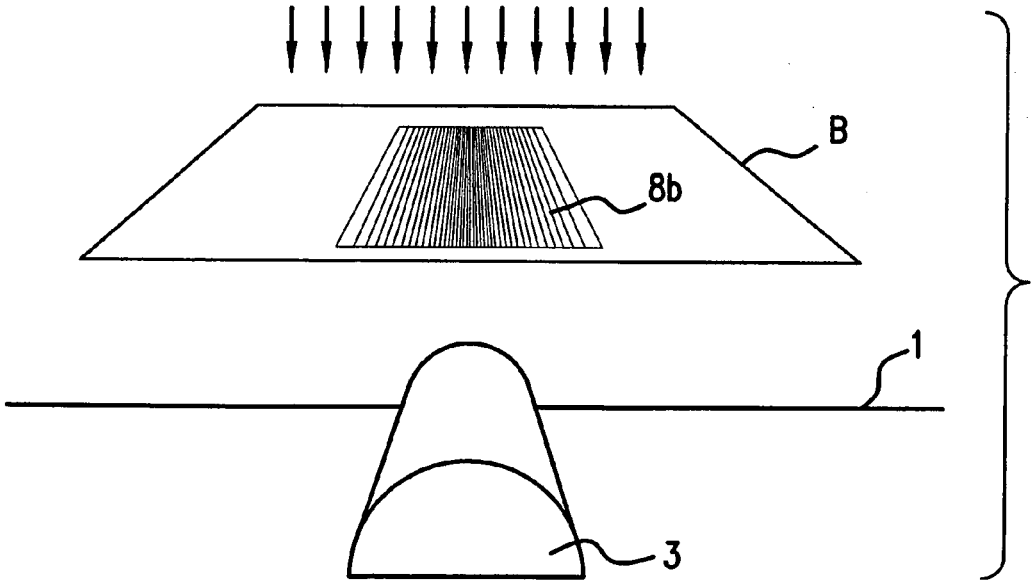
FIG. 5 is a simplified perspective view of exposure drawing using a mask B.
Figure 6A:
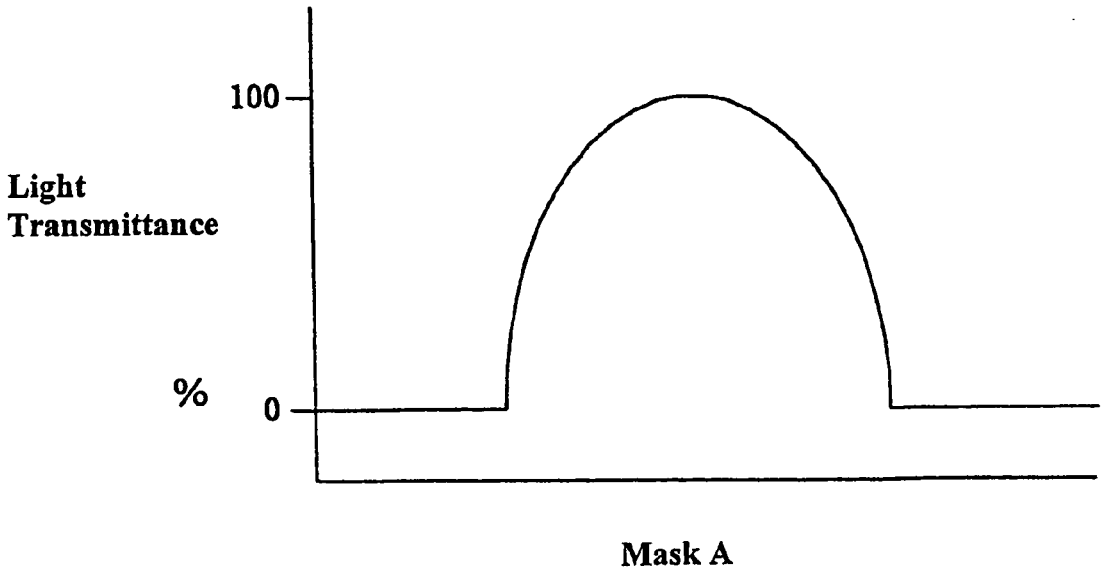
FIGS. 6A and 6B are graphs showing a relation between a light transmittance and a light-shielding film of the masks A and B, respectively.
Figure 6B:
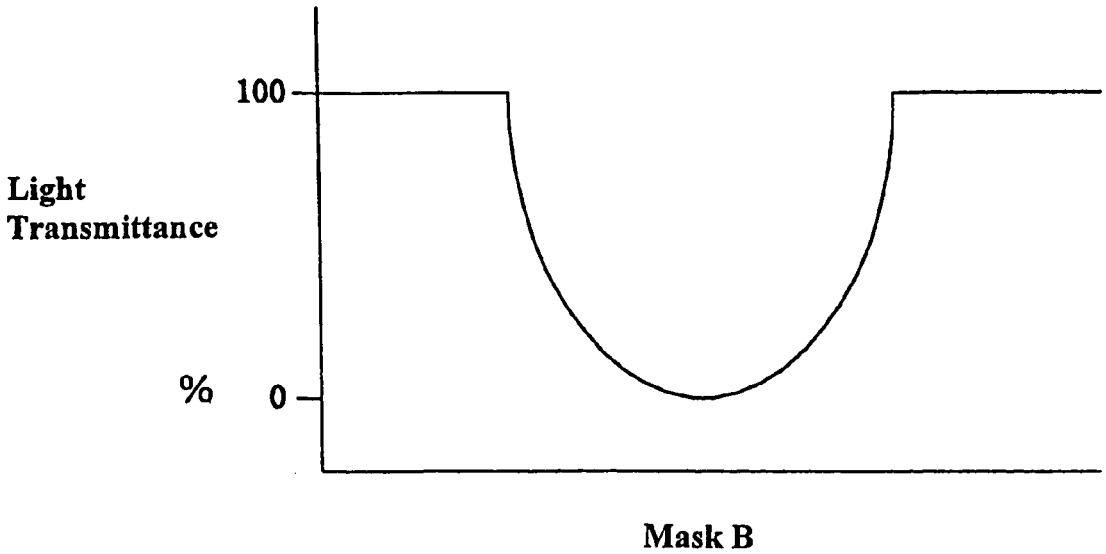

Next, a method of forming a lateral spiral coil using a mask having a light-shielding film in which an exposure amount is continuously changed from 0 to 100% is described. First, a mask used in this Example is described. FIG. 4 is a schematic perspective view of exposure drawing with the use of a mask A when forming a lateral spiral coil. FIG. 5 is a schematic perspective view of exposure drawing with the use of a mask B, and FIGS. 6A and 6B are graphs showing the relation between light transmittance and the light-shielding film of the masks A and B.

In the mask A, a light-shielding film 8 having a light transmittance of 0% for a portion outside a groove width, and a light-shielding film 8*a* in which for forming a groove 6 having a section of a half of a complete circle, a light transmittance is continuously changed from 0 to 100%, with the inside of the light-shielding film 8 directed toward the center which is the deepest position of the groove 6, are provided on a glass through which light is transmitted by 100%. Since a cylindrical portion 3 having a section of a complete circle is protruded, a mask B has a light-shielding film 8*b* in which light transmittance is continuously changed from 0 to 100% from a site that is on top of the cylindrical portion 3 toward an end that is a diameter width of the cylindrical portion 3. In the light-shielding film 8*a* of the mask A and the light-shielding film 8*b* of the mask B, the light transmittances are in an inverse relation, and exposure drawing with the section of the complete circle is conducted.

(1) Step A for Forming a Portion Which Becomes a Lower Half of a Spiral Coil

In step A is formed a groove portion 6 which becomes a lower half external portion of a spiral coil, and which has a section of a half of a complete circle on the substrate 5, as shown in FIG. 8.

Figure 7A:
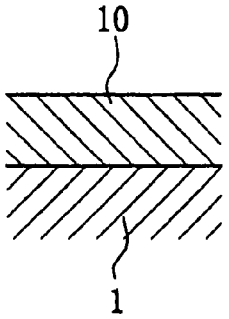
FIGS. 7A–7N constitute a flow chart of a method of manufacturing a spiral coil as shown by sectional views.
Figure 7B:
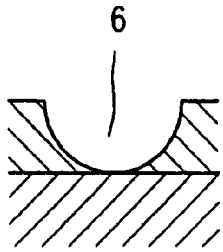
Figure 7C:
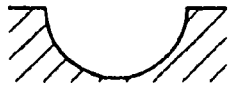

The photosensitive material 10 is coated onto the substrate 1 (FIG. 7A). In order to form the lower half of the spiral coil on the photosensitive material 10 on which a spiral coil is formed, a rectangular pattern 11 is drawn by exposure using the mask A (FIG. 7B). The photosensitive material 10 exposed is developed, and treated at a high temperature to solidify the remaining photosensitive material. As soon as the etching speeds of the photosensitive material 10 and the substrate 1 become equal, etching is conducted to directly transfer the shape of the photosensitive material 10 having the section of the half of the complete circle onto the substrate material as an undercoat, using such anisotropic dry etching conditions that the etching proceeds only vertically (FIG. 7C).

In this Example, the photosensitive material 10 is made to have the circular section in the step of FIG. 7B. However, in the invention, the sectional shape of the photosensitive material 10 is not necessarily semicircular, nor are the etching speeds of the photosensitive material 10 and the substrate material 1 necessarily equal. In this step, the conditions can be those under which the sectional shape of the groove portion 6 comes to be finally a complete circle.

(2) Step B for Forming a Metal Wiring of a Lower Half of a Spiral Coil

In step B is formed a metal wiring 12 of a lower half of a spiral coil on the groove portion 6 of the substrate 1, as shown in FIG. 9.

Figure 7D:
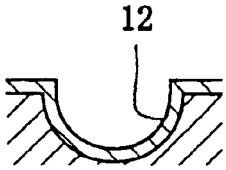
Figure 7E:
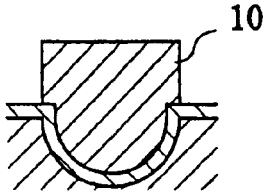
Figure 7F:
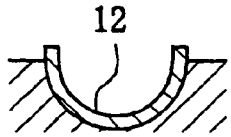

In the step A, a metal 12 such as aluminum or the like is uniformly stacked by sputtering, upon the whole surface of the substrate 1 from which the photosensitive material 10 is removed (FIG. 7D). A photosensitive material 10 is coated thereon, and an inclined ladder pattern of the lower half of the spiral coil is drawn by exposure, then developed, and treated at a high temperature (FIG. 7E). The metal 12 exposed is removed by etching, and the photosensitive material 10 is then removed (FIG. 7F).

(3) Step C for Forming a Cylinder of a Hollow Portion of a Spiral Coil with an Insulating Material In step C is formed a cylindrical portion 3 made of an insulating material 13 inside the spiral coil in which the lower half is formed as shown in FIG. 10.

Figure 7G:
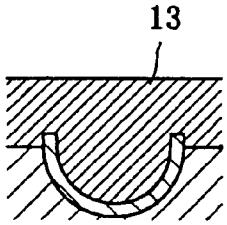
Figure 7H:
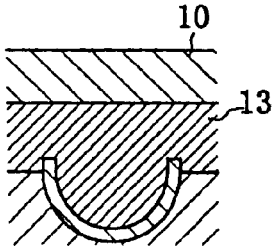
Figure 7I:
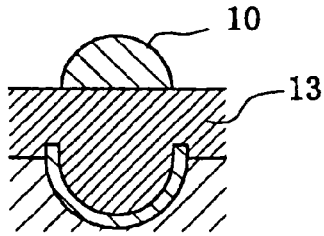
Figure 7J:
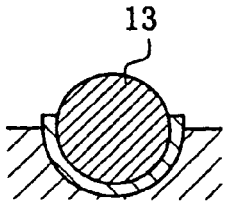

In order to form a position which becomes an inside portion of the spiral coil, an insulating material 13 such as a silicon oxide film or the like is stacked on the surface of the substrate including the spiral coil of the lower half formed in step B (FIG. 7G). The insulating material 13 is stacked such that the thickness of the insulating material 13 is equal to the diameter of the complete circle constituting the inside portion of the spiral coil in the groove portion 6. The photosensitive material 10 is coated onto the substrate 1 by adjusting the number of rotations such that the film thickness of the photosensitive material 10 is equal to the radius of the complete circle (FIG. 7H). Further, a rectangular pattern is drawn by exposure and developed using the mask B for forming the inside portion. At this time, the sectional shape of the photosensitive material 10 is similar to the semicircular shape of the spiral coil (FIG. 7I). As soon as the etching speeds of the photosensitive material 10 and the insulating material 13 become equal, the etching is conducted to directly transfer the shape of the photosensitive material 10 having the section of the half of the complete circle onto the insulating material 13 as an undercoat, using such anisotropic dry etching conditions that the etching proceeds only vertically (FIG. 7J).

In this Example, the photosensitive material 10 is made to have the circular section in the step of FIG. 7I. However, in the invention, the sectional shape of the photosensitive material 10 is not necessarily semicircular, nor are the film thicknesses and the etching speeds of the photosensitive material 10 and the insulating material 13 necessarily equal. In this step, the conditions can be those under which the sectional shape of the insulating material 13 in the inside portion comes to be finally a complete circle.

(4) Step D for Forming a Metal Wiring of an Upper Half of a Spiral Coil

In step D is formed a metal wiring 12 of an upper half (coil portion 2 and leader lines 4, 5) according to the lower half of the spiral coil formed by steps A to C, as shown in FIG. 11.

Figure 7K:
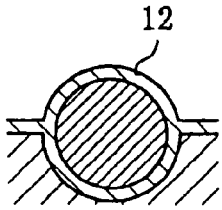
Figure 7L:
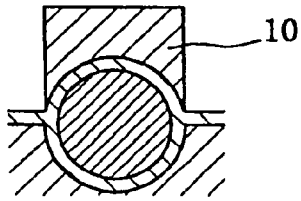
Figure 7M:
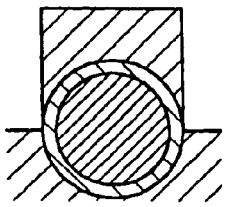
Figure 7N:
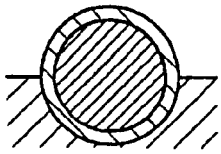

A metal 12 is uniformly stacked on the substrate, including the lower half of the spiral coil formed in the step C (FIG. 7K). The photosensitive material 10 is coated, and a ladder pattern of an upper half of the spiral coil is drawn by exposure, developed, and treated at a high temperature (FIG. 7L). As the ladder pattern at this time, a ladder pattern inclined in the opposite direction to that of the inclined ladder pattern drawn in FIG. 7E is used. The metal 4 covered with the photosensitive material 10 (coil portion 2 and leader lines 4, 5) are left over, while the other metal exposed is removed by etching (FIG. 7M), and the photosensitive material 10 is then removed (FIG. 7N).

According to this Example, since the leader lines 4, 5 extend from both ends of the spiral coil, a connection can be made with another circuit of a resistor, a condenser, a transistor or the like formed on the same substrate.

Figure 12:
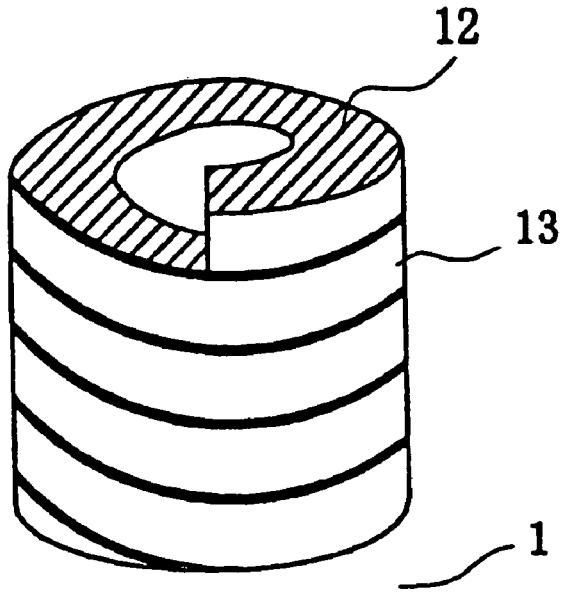
FIG. 12 is a perspective view of a longitudinal spiral coil manufactured by the method of the invention.
Figure 13:
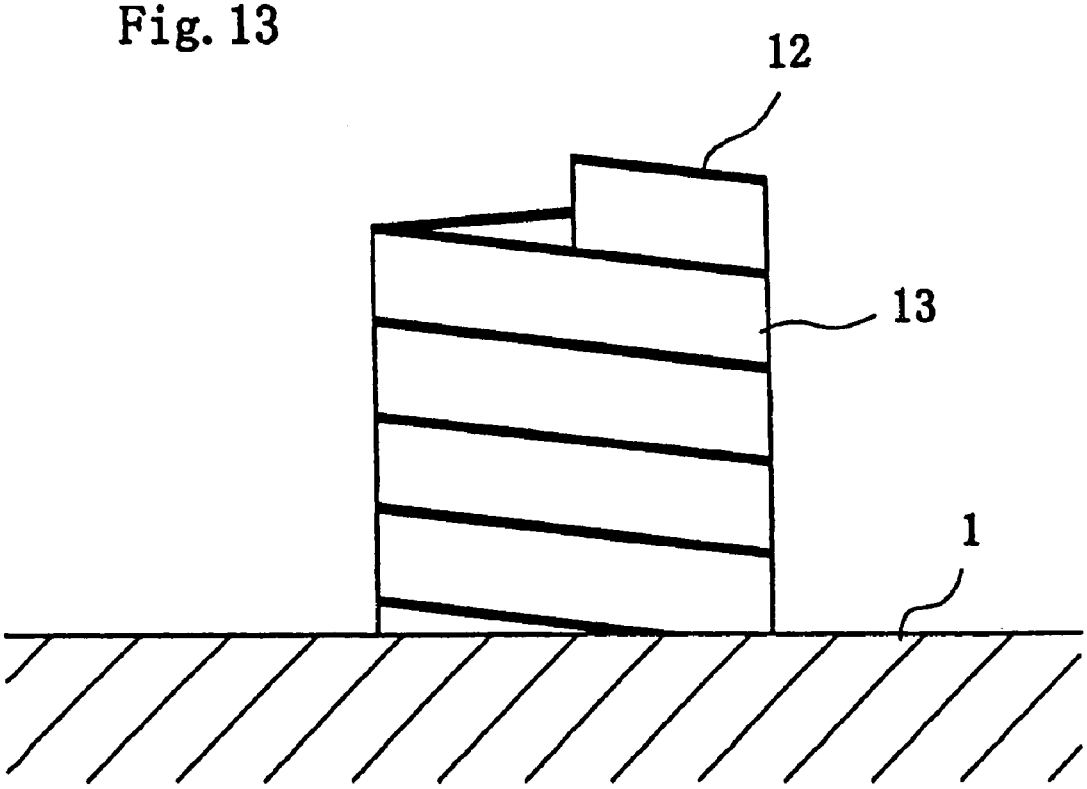
FIG. 13 is a side view of a longitudinal spiral coil manufactured by the method of the invention.

Next, a method of manufacturing a longitudinal spiral coil is described. The microsolenoid coil of this Example is a longitudinal spiral coil having a circular section (hereinafter simply referred to as a "spiral coil"). FIG. 12 is a perspective view of a longitudinal spiral coil manufactured by the method of the invention, and FIG. 13 a side view of a longitudinal spiral coil manufactured by the method of the invention.

In the longitudinal spiral coil, a coil core is vertical or inclined with a predetermined angle to the surface of the substrate. In this example, there is a structure in which the coil core is vertical to the substrate. A metal 12 and an insulating material 13 having a predetermined diameter are spirally formed on the substrate 1.

First, a mask used to form the longitudinal spiral coil is described.

Figure 14:
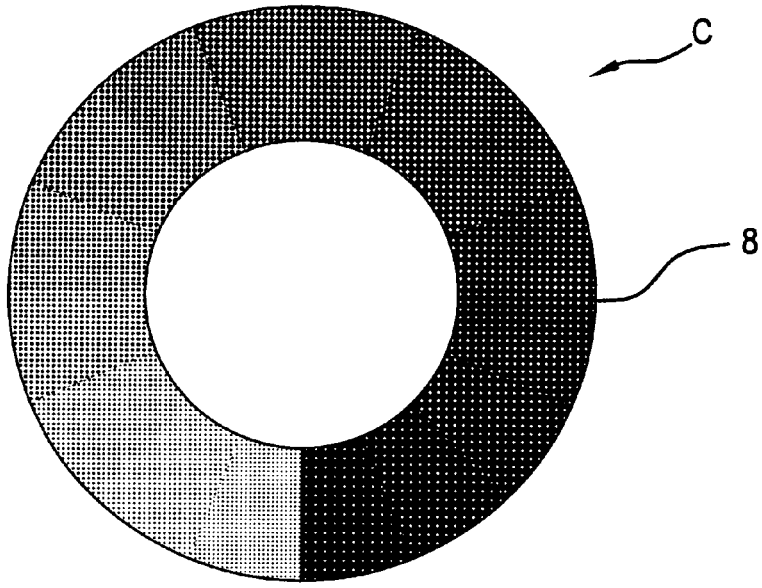
FIG. 14 is a plan view of a mask C used in forming a longitudinal spiral coil by the method of the invention.
Figure 15:
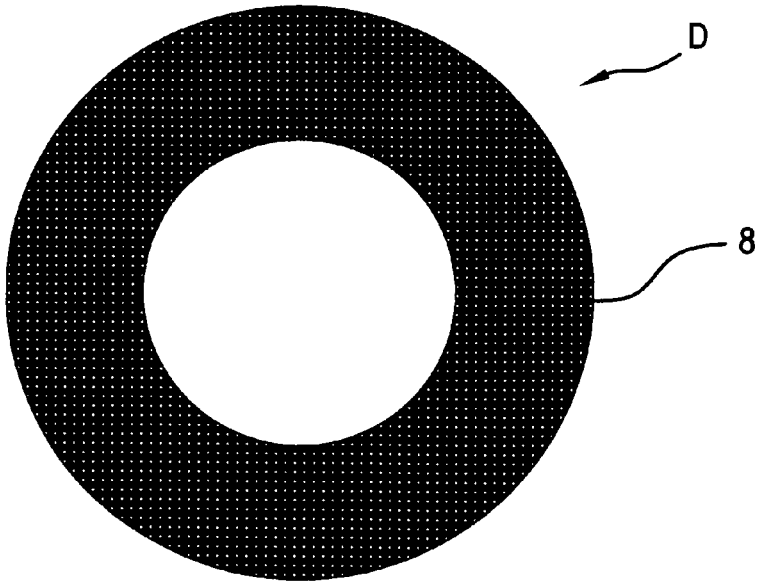
FIG. 15 is a plan view of a mask D.

FIG. 14 is a plan view of a mask C used when forming a longitudinal spiral coil, FIG. 15 a plan view of a mask D, and FIGS. 16A–16H are a series of cross-sectional views sequentially illustrating forming a longitudinal spiral structure for each winding according to the method of the invention.

The mask C has a circular light-shielding film 8 capable of continuously controlling a light transmittance from 0 to 100% on a glass through which a light is transmitted by 100%. A light in which an amount of a light for transmission through the light-shielding film 8 is controlled from 0 to 100% annularly and is continuously applied to the photosensitive material. When the photosensitive material to which only a small amount of light is only slightly applied is only slightly developed, a large amount of the photosensitive material remains. However, when a light is applied thereto to such an extent that the light is not completely sensitized, the only a very small amount of photosensitive material remains with the development. The mask D has an annular light-shielding film 8 of which the light transmittance is 0%.

(1) Method of Forming a Spiral Structure at Each Winding

Figure 16A:
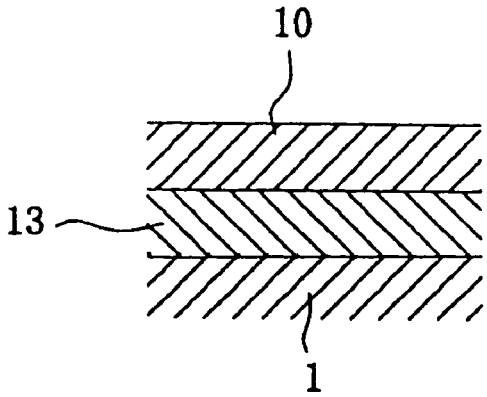
FIGS. 16A–16H constitute a flow chart of forming a longitudinal spiral structure for each winding according to the method of the invention.
Figure 16B:
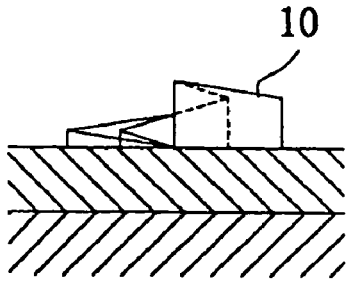
Figure 16C:
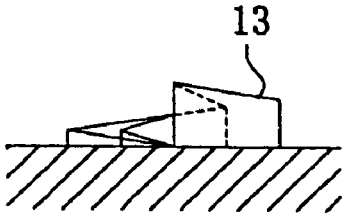
Figure 16D:
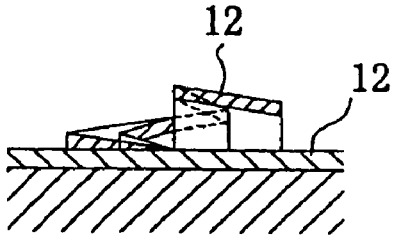
Figure 16E:
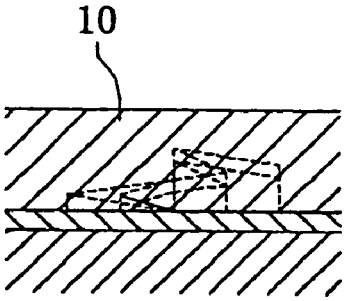
Figure 16F:
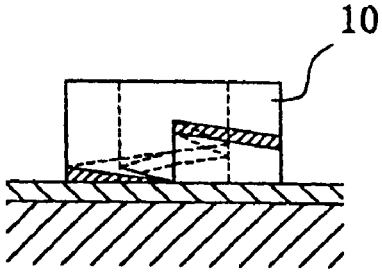
Figure 16G:
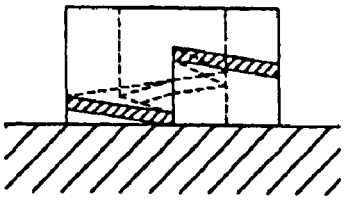
Figure 16H:
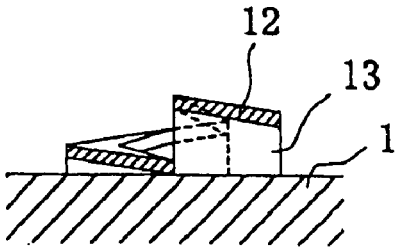

In step A is formed a coil of a first winding in a spiral structure on the substrate 1, as shown in FIG. 16H.

The insulating material 13 is stacked on the substrate 1, and the photosensitive material 10 is coated thereon (FIG. 16A). In this case, the film thickness of the photosensitive material 10 and the film thickness of the insulating material 13 are the same. Subsequently, the photosensitive material 10 is exposed and developed using the mask C, after which the spiral photosensitive material 10 is formed (FIG. 16B). Successively, the photosensitive material 10 is solidified by high-temperature treatment. The insulating material 13 under the photosensitive material 10 is formed into a spiral shape by etching (FIG. 16C), and a metal 12 is stacked on the substrate (FIG. 16D). At this time, the metal is also stacked on the upper portion of the spiral structure.

A countermeasure to be taken regarding adhesion of the metal to the side wall of the spiral insulating material as a result of the foregoing procedure is described. Regarding this countermeasure, there is a method in which the side wall of the insulating material has a structure such that the metal is not adhered thereto, and/or a method of removing metal which has adhered.

As an example of the former, the side wall is formed in an inverted taper shape. In this method, when the etching is conducted in the depth direction using the photosensitive material as a mask, the rate in which the etching in the lateral direction is conducted is increased according to the deeper etching, with the result that the inverted taper shape is provided. This shape is formed by appropriately controlling the type of the etching gas, the pressure in the reaction, and the electric power for meeting such conditions.

The latter method utilizes the fact that the thickness of the metal stacked on the surface of the substrate is great, while the thickness of the metal adhered to the side wall is small; that is, the thickness of the metal stacked is smaller in the lateral direction than in the longitudinal direction. First, the metal is stacked on the whole surface of the substrate. Then, the metal of the thickness adhered to the side wall is etched. At this time, the etching is conducted under etching conditions controlled such that the etching rates in the longitudinal and lateral directions are equal. After this etching is conducted, the metal adhered to the side wall is removed. Meanwhile, the portion stacked on the surface except for the side wall becomes thin by somewhat etching of the surface, yet the thickness required for the coil remains. Thereafter, a lithographic step of forming the coil portion proceeds.

The photosensitive material 10 is coated (FIG. 16E). At this time, the film thickness of the photosensitive material 10 may be such that it covers the substrate 1 sufficiently. When the exposure and the development are then conducted using the mask D, the photosensitive material 10 covering only the metal on the base of the spiral structure remains (FIG. 16F). The high-temperature treatment is then conducted, the metal 12 exposed is etched (FIG. 16G), and the photosensitive material 10 is then removed (FIG. 16H).

Figure 17I:
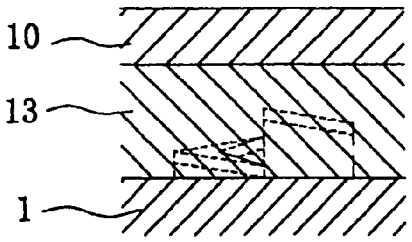
FIGS. 17I–17O constitute a flow chart of the method of forming a longitudinal spiral structure for each winding according to the invention subsequent to the step of FIG. 16H.
Figure 17J:
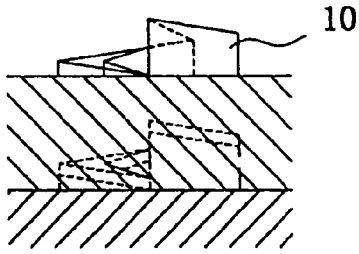
Figure 17K:
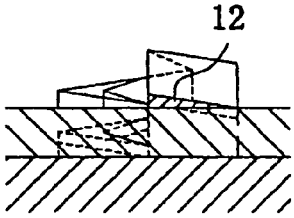
Figure 17L:
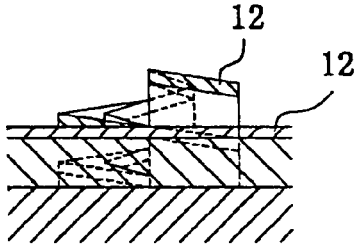
Figure 17M:
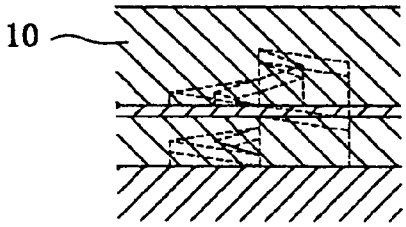
Figure 17N:
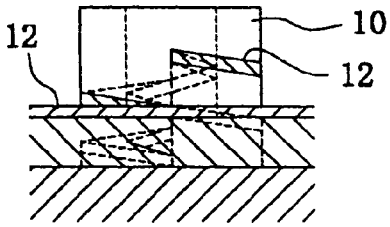
Figure 17O:
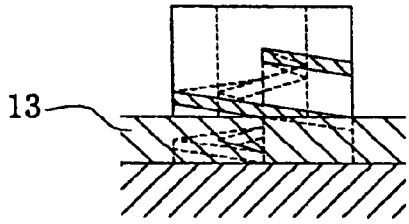
Figure 17P:
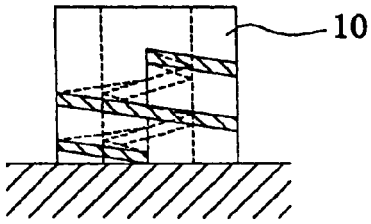
Figure 17Q:
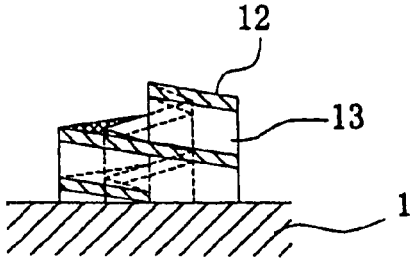

In step B is formed a coil of the second winding on the coil of the first winding formed by step A, as shown in FIG. 17Q.

The insulating material 13 is stacked to a thickness which is twice that of the first layer, and the photosensitive material 10 is then coated. At this time, the photosensitive material 10 is made to have the same thickness as that of the first layer of the spiral structure (FIG. 17I). When it is exposed and developed using the mask C, the spiral photosensitive material 10 is formed (FIG. 17J). After the high-temperature treatment is conducted, a base of a second layer is formed by etching. Then, a part of the metal 12 on the first layer is exposed (FIG. 17K). This end surface is electrically connected with the metal 12 of the second layer.

The metal 12 is stacked on the whole surface of the substrate (FIG. 17L). The photosensitive material 10 is coated (FIG. 17M), and then exposed and developed using the mask D. Consequently, the photosensitive material 10 covering the metal 12 of the spiral structure remains (FIG. 17N). After the high-temperature treatment is conducted, the exposed metal 12 is etched (FIG. 17O), the insulating material 13 remaining except the spiral structure is further removed by etching (FIG. 17P), and the photosensitive material 10 is removed (FIG. 17Q).

(2) Method of Formation at Each ½ Winding

Figure 18:
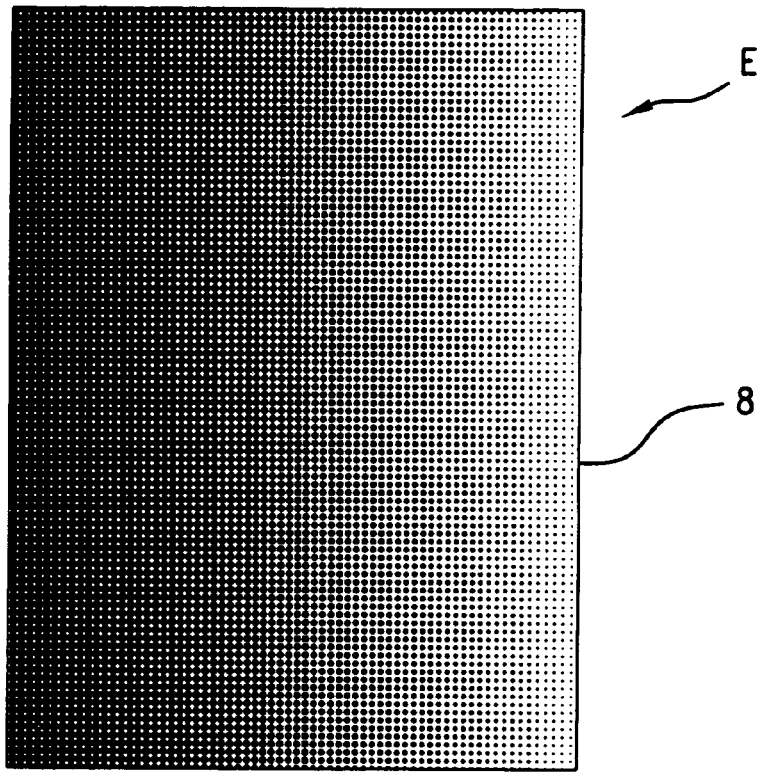
FIG. 18 is a plan view of a mask E in forming a longitudinal spiral coil for each ½ winding according to the method of the invention.
Figure 19:
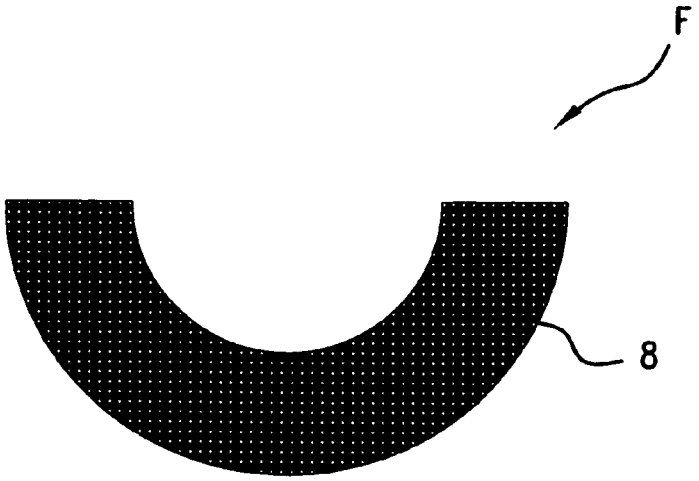
FIG. 19 is a plan view of a mask F.

A mask used for forming a longitudinal spiral coil of this Example is described. FIG. 18 is a plan view of a mask E used to form a longitudinal spiral coil at each ½ winding, and FIG. 19 a plan view of a mask F. The mask E has a light-shielding film 8 capable of continuously controlling a light transmittance from 0 to 100% with a fixed width. Further, the mask F has a semicircular light-shielding film 8 having a light transmittance of 0%.

Figure 20A:
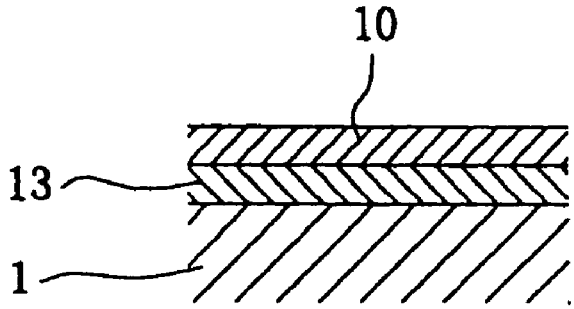
FIGS. 20A–20H constitute a flow chart of forming a longitudinal spiral structure for each ½ winding according to the method of the invention.
Figure 20B:
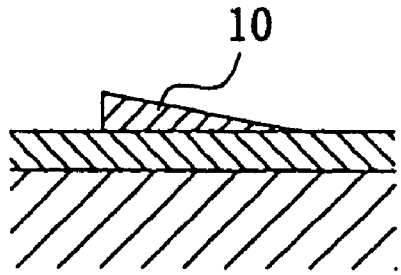
Figure 20C:
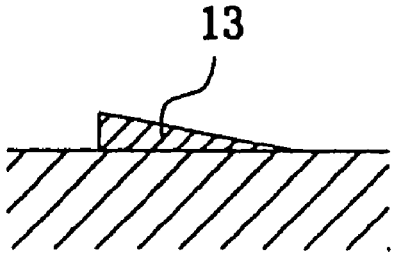
Figure 20D:
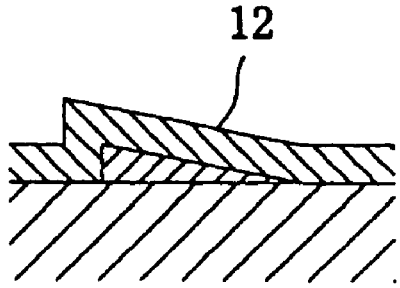
Figure 20E:
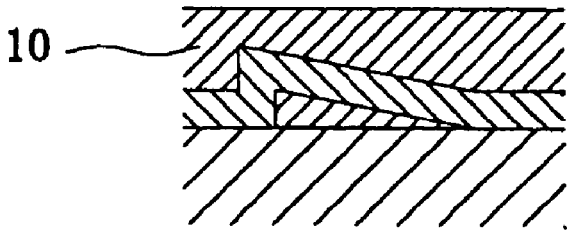
Figure 20F:
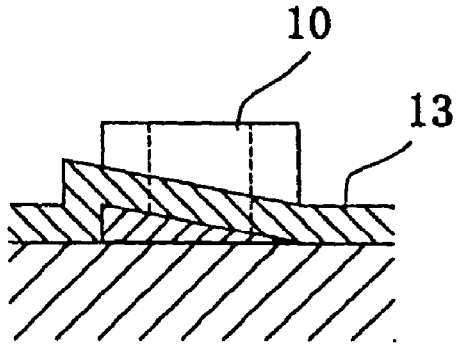
Figure 20G:
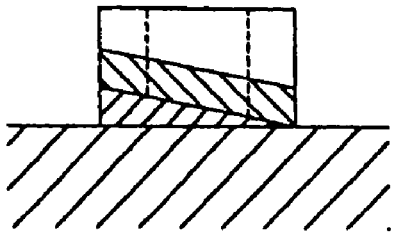
Figure 20H:
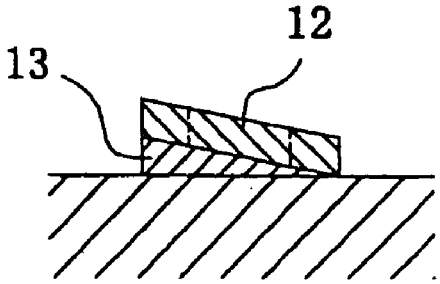

The insulating material 13 is stacked on the substrate 1, and the photosensitive material 10 is then coated (FIG. 20A). When it is exposed and developed using the mask E, the photosensitive material 10 having a structure of an inclined section is formed (FIG. 20B). After the high-temperature treatment is conducted, the insulating material 13 of the inclined structure is formed by etching (FIG. 20C). The metal 12 is stacked on the whole surface of the substrate 1 (FIG. 20D), and the photosensitive material 10 is coated (FIG. 20E). When it is exposed and developed using the mask F, the photosensitive material 10 covering the metal 12 on the inclined surface remains (FIG. 20F). After the high-temperature treatment is conducted, the exposed metal 12 is etched (FIG. 20G), and the photosensitive material 10 is removed (FIG. 20H).

Figure 21I:
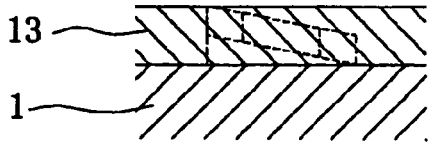
FIGS. 21I–21R constitute a flow chart of the method of forming a longitudinal spiral structure for each ½ winding according to the invention subsequent to the step of FIG. 20H.
Figure 21J:
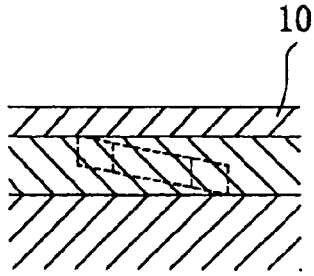
Figure 21K:
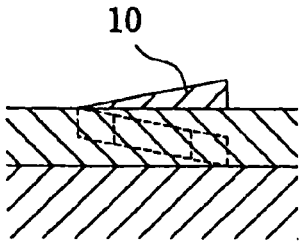
Figure 21L:
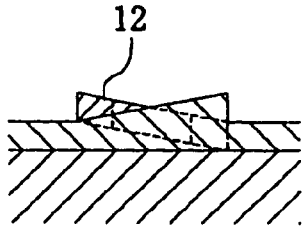
Figure 21M:
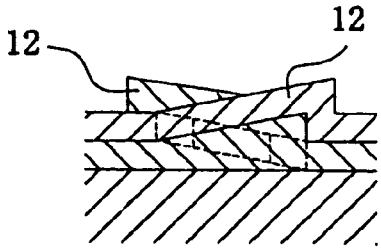
Figure 21N:
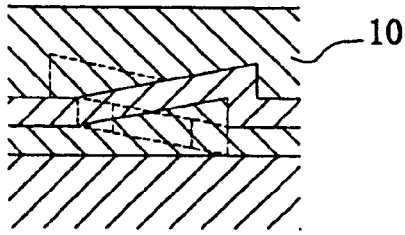
Figure 21O:
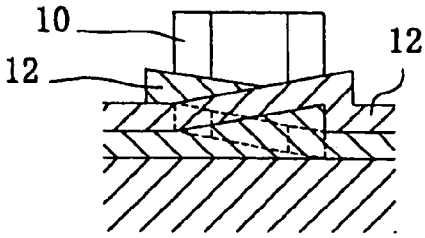
Figure 21P:
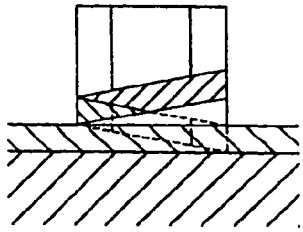
Figure 21Q:
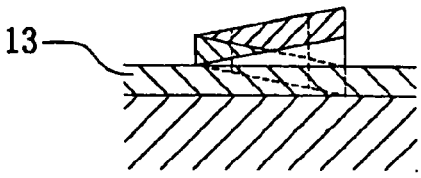

The insulating material 13 is stacked to a film thickness which is twice the film thickness in FIG. 20A, namely to a height with which to cover the metal 12 (FIG. 21I), and the photosensitive material 10 is coated (FIG. 21J). When it is exposed and developed using the mask E, the photosensitive material 10 having a structure inclined in the opposite direction to that in FIG. 20C is formed (FIG. 21K). After the high-temperature treatment is conducted, when etching is conducted, a form in which the metal 12 is partially exposed is provided as shown in the drawing (FIG. 21L). The metal 12 is stacked (FIG. 21M). The photosensitive material 10 is coated, and exposed and developed using a vertically inverted mask of the mask F. Then, the photosensitive material 10 covering the metal 12 on the inclined structure remains (FIG. 21O). After the high-temperature treatment is conducted, the exposed metal 12 is etched (FIG. 21P), and the photosensitive material 10 is removed (FIG. 21Q).

Figure 21R:
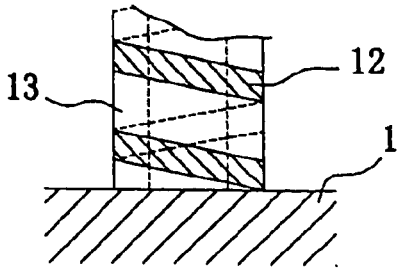

The steps I to Q are repeated, and the insulating material 13 except for the spiral structure is finally etched, whereby the spiral coil of multiple winding shown in FIG. 21R is formed.

The two methods have been thus far more or less separately described. Further, a method with partial modification is also described.

(I) Method of Forming a Spiral Structure at Each Winding (A) In the case where the metal is also adhered to the side wall of the spiral base in stacking the metal, one must add a step of removing the metal adhered to a side wall of a step (i.e., a difference in level) located at an interface between a lowermost layer and an uppermost layer of a ring rather than at inner and outer peripheries of the base.

(B) A metal oxide film is formed in lieu of stacking the insulating material between metal wirings on an upper layer except the base of the lowermost layer. Since the surface of the metal is oxidized after stacking the metal, the step (process) can be shortened or "condensed". However, in this case as well, it is required to remove the upper metal of the overlapped portion as in (A), and to selectively remove the surface of the metal on the portion removed.

(2) Method of Formation at Each ½ Winding (A) A metal oxide film is formed as in (1)(B). However, here there is no need to partially remove and oxidize the same. A lithographic step for forming a base of a second layer and those steps following are unnecessary, and a winding coil with a high density can be formed by using the metal oxide film.

Incidentally, when the bases are all made of an insulating material in the method of (2), the respective bases can be formed with their required angles.

In this Example, leader lines drawn (extended) from both ends of the coil are not described. However, these can be drawn in optional directions. A coil can also be formed by a number of windings other than 1 winding and/or ½ winding. Further, a sectional shape or the whole shape of the coil can be another shape such as an elliptical, rhombic, barrel-like or bobbin-like shape. Still further, a clockwise or counterclockwise winding can be formed. Furthermore, two or more coil windings can be formed cylindrically. Moreover, two or more coils can be formed concentrically. Thus, a larger inductance can be obtained by connecting the coils. In addition, with respect to a method of forming a photosensitive material into a spiral shape, light transmittance can be adjusted, besides by changing the thickness of the light-shielding film on the mask, by forming a hole proportional to the light transmittance in the light-shielding film, or by placing the light-shielding film on another glass surface for spacing out a distance apart from a focal position of projection exposure and by using a shadow formed at that time. This formation also be performed by directly applying electron beams or laser beams to the photosensitive material. It can also be formed by directly applying ion beams to the insulating material. It can likewise be formed by continuously controlling the amount of reflected light of a reflection-type mask, other than the transmission-type mask, from 0% to 100%.

Further, it is also possible to remove only the photosensitive material at the annular portion on the base, and to form the formation without stacking metal on any portions other than this portion. This method also prevents the metal from being adhered to the side wall of the step portion present on the lowermost layer and the uppermost layer of the spiral structure. Still further, the base itself may be formed of a metal. Furthermore, the hollow portion of the coil can be formed by placing a thin insulating material between a metallic material such as an iron core or the like and a metal of the core portion such that these are prevented from coming in contact with each other. In addition, a larger inductance can be obtained by arranging a magnetic material outside the hollow portion of the coil.

The "base" described above means only the base of the first layer. In another view, however, it is also possible that, instead, the portion of the metallic layer which becomes the coil be made of the insulating material, and the portion of the insulating material which becomes the base be made of the metal. It is also possible to form the base only via exposure using a thermosetting resin.

Here, for forming the spiral structure, the film thicknesses of the photosensitive material and the insulating material are made to be the same, and the etching rates thereof are also made to be the same. However, the spiral shape of the insulating material may finally be formed according to the purpose, and the foregoing relation may be optional. Further, this can also be used in a screw for a micro-machine, which, however, has no bearing on the coil.

After the completion of the spiral coil in this Example, a heating step is conducted for strengthening the connected portion of the metals.

The invention can be worked using the following materials.

Examples of the substrate include semiconductor materials such as silicon, germanium, gallium arsenic, gallium phosphorus, indium antimony, aluminum nitride and the like, insulating materials such as glass, ceramics, alumina, diamond, sapphire and the like, organic materials such as plastics and the like, metals such as aluminum, stainless steel and the like, magnetic materials such as iron and iron alloy materials, oxide materials such as ferrite and the like, and so forth.

Examples of the undercoat material include insulating materials such as a silicon oxide film, a silicon nitride film and the like, semiconductor materials such as amorphous silicon, polysilicon and the like, organic materials such as a polyimide and the like, magnetic materials, and so forth.

Examples of the base include insulating materials such as an oxide film and the like, a substrate or semiconductor materials having the same high resistance as the substrate, insulating organic materials, thermosetting resins, and so forth.

Examples of the coil material include metals such as aluminum, titanium, tungsten, copper, chrome and the like, alloys thereof, doped semiconductor materials having a low resistance, conductive organic materials, transparent conductive materials such as ITO and the like, high-temperature superconductive materials such as copper oxide and the like, and so forth.

Examples of the cylindrical portion and the coil peripheral portion include air, insulating materials such as oxide films, organic materials and the like, magnetic materials such as an Mn—Zn-based ferrite, a Co-based amorphous alloy, a ferrite.Mo bermalloy and the like, substrate materials or semiconductor materials, metals such as iron and the like which have an insulating material inserted between them and a coil, superconductive materials, and so forth.

Other working examples of the invention are next described.

(1) In this Example, the method of directly forming the coil on the substrate has been described. However, it is also possible that another film be stacked on the substrate, and that this be formed in the shape of the film.

(2) It is also possible that the coil be completely covered with the insulating material, and that another coil be formed and stacked on the upper portion.

(3) The shape of the coil is not limited to a cylindrical shape. A coil having a barrel-like shape with a raised center, or a bobbin-like shape with a depressed center, can also be formed. This shape can be made into various different shapes.

(4) The position of the leader lines does not necessarily have to be at both ends of the coil as shown in FIG. 11; these can also be drawn from any desired position. Accordingly, a large number of leader lines can be drawn.

(5) The hollow portion of the coil can be formed by placement of a thin insulating film other than the insulating material such that there is no contact between a metallic material such as an iron core or the like, and/or an oxide material such as a ferrite or the like, and the metal of the coil portion.

(6) The formation of the upper half can be performed only by exposure through the use of a thermosetting resin in the cylinder of the coil hollow portion.

Figure 22:
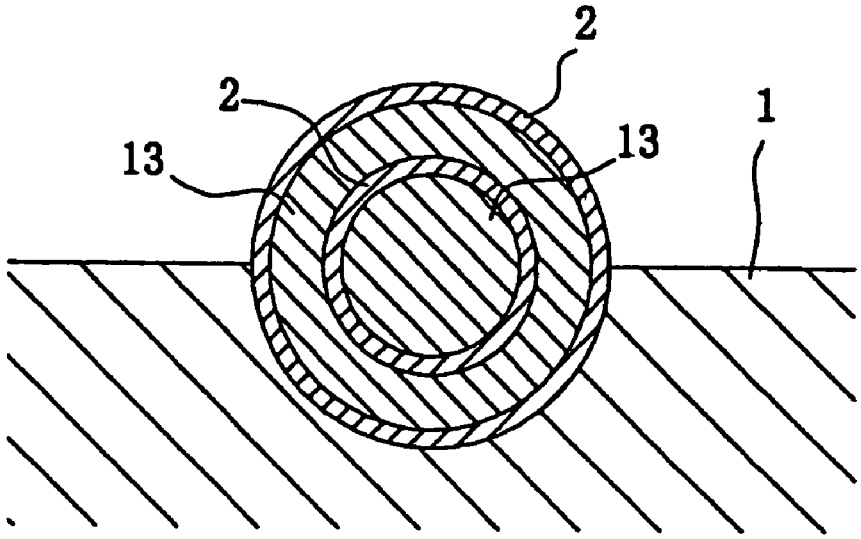
FIG. 22 is a sectional view of plural spiral coils arranged concentrically.

(7) Two, three or more coils can be formed concentrically at the same time, as shown in FIG. 22. In the coils, the semicircle of the lower half is formed in order from the outside to the inside, and the semicircle of the upper half is then formed in order from the inside to the outside.

Figure 23:
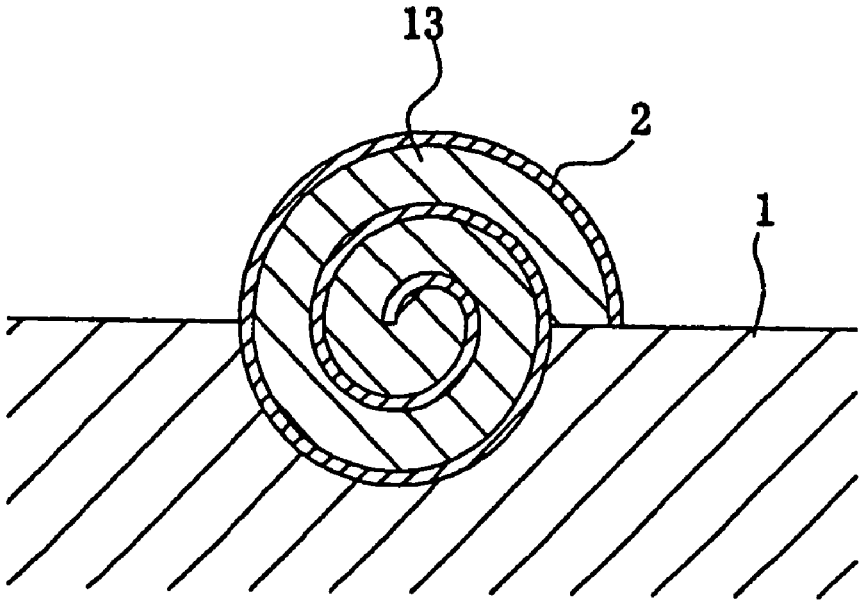
FIG. 23 is a sectional view of a lateral spiral coil.

(8) A lateral spiral coil of which the axial direction is parallel to the substrate surface, as shown in FIG. 23, can be formed. The pattern of the spiral coil to be formed is cut horizontally into a lower half and an upper half so as to penetrate the center of the pattern, and these are formed separately. That is, the lower half of the spiral coil is formed continuously from the outside pattern by a method in which a lower half is formed with a lateral spiral coil, and the upper half is then formed from the inside.

Figure 24:
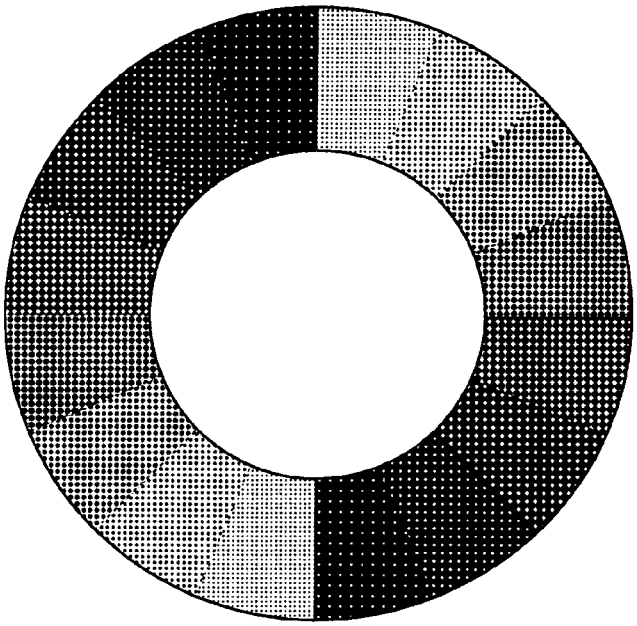
FIG. 24 is a plan view of a mask used when a double longitudinal spiral coil is formed in the same circumference.

II. Longitudinal Spiral Coil (1) In order to form two, three or more coils concentrically at the same time, a mask shown in FIG. 24 is used. The mask is formed such that in the left half of the ring a transmitted light is increased from an upper part to a lower part, while in the right half a transmitted light is increased from a lower part to an upper part.

Figure 25:
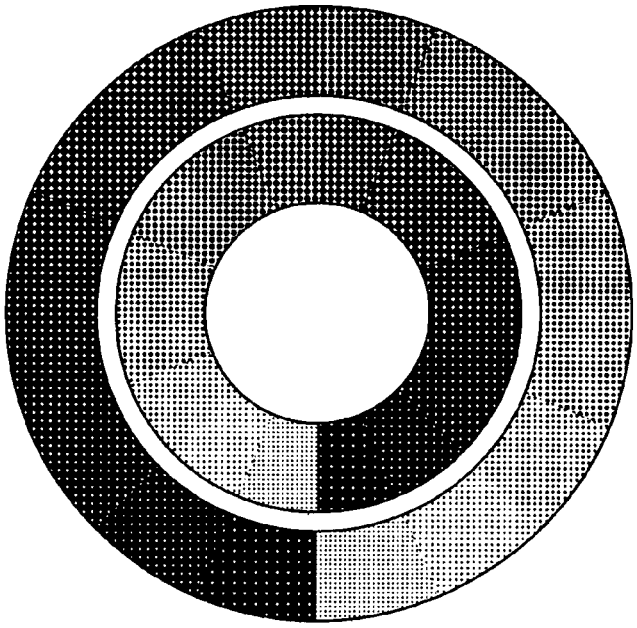
FIG. 25 is a plan view of a mask used when a double spiral coil is formed concentrically.
Figure 26:
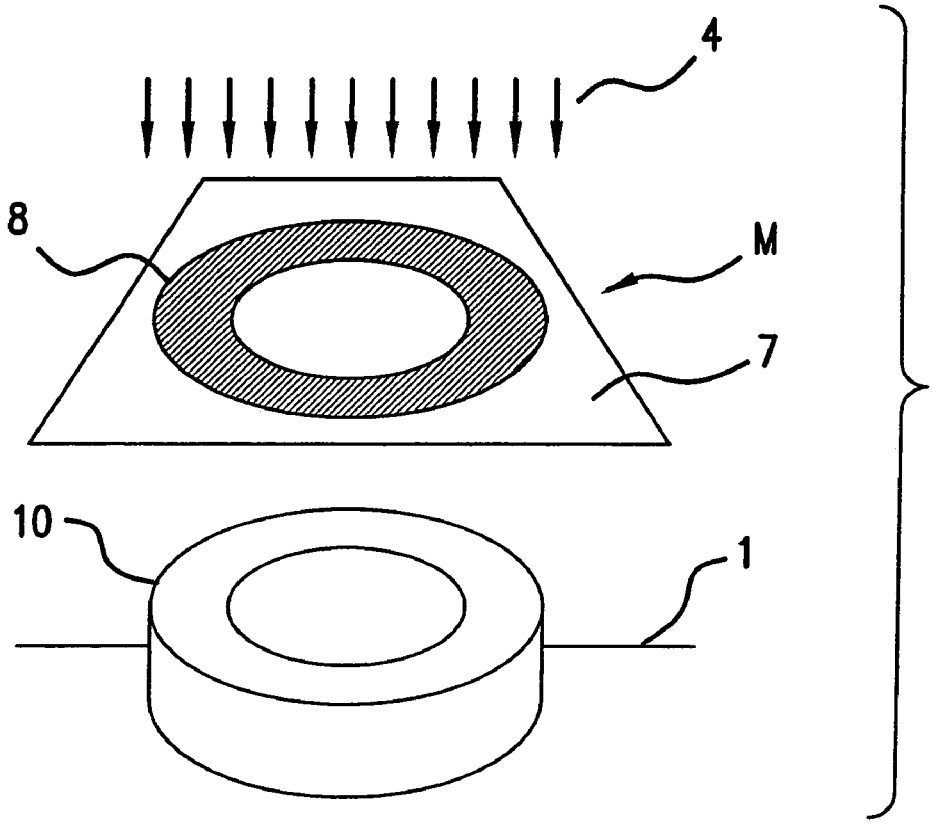
FIG. 26 is a schematic view of an ordinary projection exposure device.

(2) A coil can also be formed with double, triple or more windings. A larger inductance can be obtained by connecting the respective coils. A mask shown in FIG. 25 is used in the production of this coil. The mask is formed such that in the inside ring a transmitted light is increased from a right lower part to a left lower part, and in the outside ring a transmitted light is increased from a left lower part to a right lower part.

(3) Coil with Multiple Windings in One Exposure, which is a Type of Longitudinal Coil The multiple winding indicates a spiral pattern. However, it indicates not a plain spiral pattern, but a three-dimensional spiral pattern. It is formed by alternately laminating a concave spiral pattern raised from the center to the outside, and a convex spiral pattern raised from the outside to the center. Clockwise winging and counterclockwise winding can also be provided.

III. Coil Obtained by Combining a Lateral Spiral Coil and a Longitudinal Spiral Coil A longitudinal base is formed by one winding or by one-half (½) winding. Then, a lower half of a lateral coil is formed on the base. That is, a groove having a semicircular section and a ladder-shaped metal pattern are formed. Subsequently, a cylindrical portion is formed. Further, a ladder-shaped metal pattern which becomes an upper portion of the lateral coil is formed on the cylinder. Thereafter, the longitudinal base is formed, and the lateral coil is likewise formed.

IV. Method of Separating a Coil from a Substrate

A material different from the respective materials of the substrate and the coil is placed in advance between the substrate and the coil. After the coil is completed, the coil is separated from the substrate by etching the material between the substrate and the coil. Alternatively, the coil is separated from the substrate by etching the substrate itself.

INDUSTRIAL APPLICABILITY

As has been described above, the microsolenoid coil and the method of manufacturing the same according to the invention can be applied to various micro-circuits such as a coil for inductance or a transformer of a semiconductor integrated circuit, an electromagnetic coil constituting an electromagnetic motor or a micro-engine which is a power supply of a micromachine, a sensor for transmitting and receiving magnetic signals, parts of a circuit for magnetically processing and recording information, and the like.

The invention claimed is:

1. A method of manufacturing a longitudinal microsolenoid, which comprises a step A of stacking an insulating material on a substrate, coating a photosensitive material thereon, and exposing and then developing the photosensitive material using a mask C to form a spiral photosensitive material, a step B of, after said step A, solidifying the photosensitive material by treatment at a high temperature, forming an insulating material under the photosensitive material into a spiral shape by etching, and stacking a metal on the substrate, a step C of, after said step B, coating a photosensitive material, and exposing and developing the photosensitive material using a mask D to leave the photosensitive material covering only the metal on a base of the spiral structure, and a step D of, after said step C, conducting high-temperature treatment, etching the metal that is exposed, and then removing the photosensitive material, said mask C being such that a light-shielding film capable of controlling a light transmittance from 100% to 0% annularly and continuously is provided on a glass through which a light is transmitted by 100%, and such that said mask D has an annular light-shielding film with a light transmittance of 0%.

* * * * *